US008272969B2

(12) United States Patent
Priegel

(10) Patent No.: US 8,272,969 B2
(45) Date of Patent: Sep. 25, 2012

(54) FLAGPOLE AND FERRULE ASSEMBLY

(75) Inventor: Jack C. Priegel, El Paso, TX (US)

(73) Assignee: Wind Gear Direct, LLC, El Paso, TX (US)

( * ) Notice: Subject to any disclaimer, the term of this patent is extended or adjusted under 35 U.S.C. 154(b) by 195 days.

(21) Appl. No.: 12/847,626

(22) Filed: Jul. 30, 2010

(65) Prior Publication Data

US 2012/0028725 A1 Feb. 2, 2012

(51) Int. Cl.
*A63B 57/00* (2006.01)

(52) U.S. Cl. ..... 473/176; 116/173; 264/328.1

(58) Field of Classification Search ..... 473/176–178; 116/173, 174; 264/297.2, 328.1
See application file for complete search history.

(56) References Cited

U.S. PATENT DOCUMENTS

| | | | | |
|---|---|---|---|---|
| 1,676,954 | A | 7/1928 | Kannemann | |
| 2,678,853 | A | 5/1954 | Reeder | |
| 2,939,163 | A | 6/1960 | Yonkers | |
| 3,348,797 | A | 10/1967 | Turbyfill | |
| RE26,769 | E | 1/1970 | van Buren, Jr. | |
| 3,732,845 | A | 5/1973 | Istre | |
| 3,779,659 | A | 12/1973 | Habert | |
| 4,114,879 | A | 9/1978 | Oiler | |
| 4,120,496 | A | 10/1978 | Niina | |
| 4,407,505 | A | 10/1983 | Kendziorski | |
| 4,516,615 | A | 5/1985 | Finn | |
| 4,705,424 | A | 11/1987 | Raycher et al. | |
| 4,928,417 | A | 5/1990 | Boudreau | |
| 5,249,384 | A | 10/1993 | Dark, Jr. | |
| 5,351,950 | A | 10/1994 | Frankum | |
| 5,382,018 | A | 1/1995 | Browne | |
| 5,398,927 | A | 3/1995 | O'Sullivan | |
| 5,451,045 | A * | 9/1995 | Garske | 473/176 |
| 6,113,503 | A | 9/2000 | Brookman | |
| 6,409,608 | B1 | 6/2002 | Garske | |
| 6,471,438 | B2 | 10/2002 | Faris | |
| 6,478,687 | B1 | 11/2002 | Colonello | |
| 6,712,714 | B2 | 3/2004 | Joswick | |
| 6,722,997 | B2 | 4/2004 | Gilmour | |
| 6,726,170 | B2 | 4/2004 | Luo | |
| 6,726,575 | B1 | 4/2004 | Thorp et al. | |
| 6,767,289 | B2 | 7/2004 | Porter | |
| 6,902,491 | B2 | 6/2005 | Barlow et al. | |
| 6,939,239 | B1 | 9/2005 | Ash | |
| 7,033,279 | B2 | 4/2006 | Garske | |

(Continued)

FOREIGN PATENT DOCUMENTS

JP 09-184117 A 7/1997

(Continued)

OTHER PUBLICATIONS

Reliable Golf Course Supplies, 2006 Golf Course Supply Catalog, p. 23.

(Continued)

*Primary Examiner* — Mark Graham
(74) *Attorney, Agent, or Firm* — Fitch, Even, Tabin & Flannery, LLP

(57) ABSTRACT

A golf flagpole and ferrule assembly for mounting in a golf cup hole is disclosed. The flagpole and ferrule both include cooperating coupling parts to form an attachment therebetween. A cap is applied over portions of the flagpole and the ferrule to couple to the retaining members and secure the flagpole to the ferrule.

13 Claims, 9 Drawing Sheets

U.S. PATENT DOCUMENTS

| | | | | |
|---|---|---|---|---|
| 7,033,280 | B2 | 4/2006 | Hottle et al. | |
| 7,455,594 | B1 | 11/2008 | Priegel | |
| 7,500,919 | B2 | 3/2009 | Priegel | |
| 2002/0094878 | A1 | 7/2002 | Porter | |
| 2002/0198059 | A1 | 12/2002 | Gilmour | |
| 2005/0272515 | A1 | 12/2005 | Hurley et al. | |
| 2006/0189401 | A1 | 8/2006 | Garske | |
| 2008/0171609 | A1 * | 7/2008 | Priegel | 473/176 |
| 2009/0280919 | A1 * | 11/2009 | Prince | 473/176 |

FOREIGN PATENT DOCUMENTS

| | | | |
|---|---|---|---|
| JP | 11-239627 | A | 9/1999 |

OTHER PUBLICATIONS

International Search Report of the Korean Intellectual Property Office for International Application No. PCT/US2008/055289 dated Jun. 30, 2008 (2 pages).

* cited by examiner

FLAGPOLE AND FERRULE ASSEMBLY

FIELD

The apparatus and methods described herein relate to a mounting device for a flagpole, and in particular, to a flagpole assembly for mounting in a golf cup.

BACKGROUND

In order to support a golf flagpole within a golf cup, the flagpole is typically attached to a ferrule, which may be formed from a soft metal, such as zinc, a zinc alloy, or aluminum, at a lower end of the flagpole. The metal ferrule facilitates insertion of the flagpole into a receiving hole positioned in the center of the golf cup, which is often fabricated out of plastic. In this manner, the flagpole is secured to the golf cup and positioned to display the golf cup location to an approaching golfer. The prior soft metal ferrules, however, can be easily dented, damaged, or otherwise deformed leading to a poor coupling with the golf cup.

The flagpole is often fabricated out of fiberglass or wood and secured to the metal ferrule, usually by insertion through a bore in the center of the ferrule. To insure attachment of the pole to the ferrule, adhesive may be employed to form a bond between the pole and ferrule. However, if the proper type or amount of adhesive is not used, or if curing conditions are not optimal, then the pin and ferrule may separate when golfers grasp and lift the flag stick out of the cup. Over time, the adhesive bond may also fail or weaken. On the other hand, attempting to employ an adhesiveless, friction-type fit between the fiberglass or wood pole and metal ferrule has also been unsatisfactory. Over time, the differences in surfaces between the fiberglass or wood and the metal ferrule combined with the repeated removal from the golf cup can result in a separation between the pole and ferrule, such as when the metal cuts into the fiberglass or wood and thereby decreases the tightness of the friction-type fit.

Attaching the flagpole to the ferrule using screws, bolts, or crimping has also been employed to secure the flagpole to the ferrule. However, these applications typically require openings or bores in outer surfaces of the ferrule so that the screws or crimping tools can access the flagpole within the ferrule. The openings, however, can allow sand, rocks, or other debris that commonly falls into a golf cup to enter the ferrule and interfere with the connection between the ferrule and the flagpole, leading to scratches, small deformations, and accelerated wear and corrosion of the ferrule and flagpole.

DETAILED DESCRIPTION OF THE PREFERRED EMBODIMENTS

Figure 1:
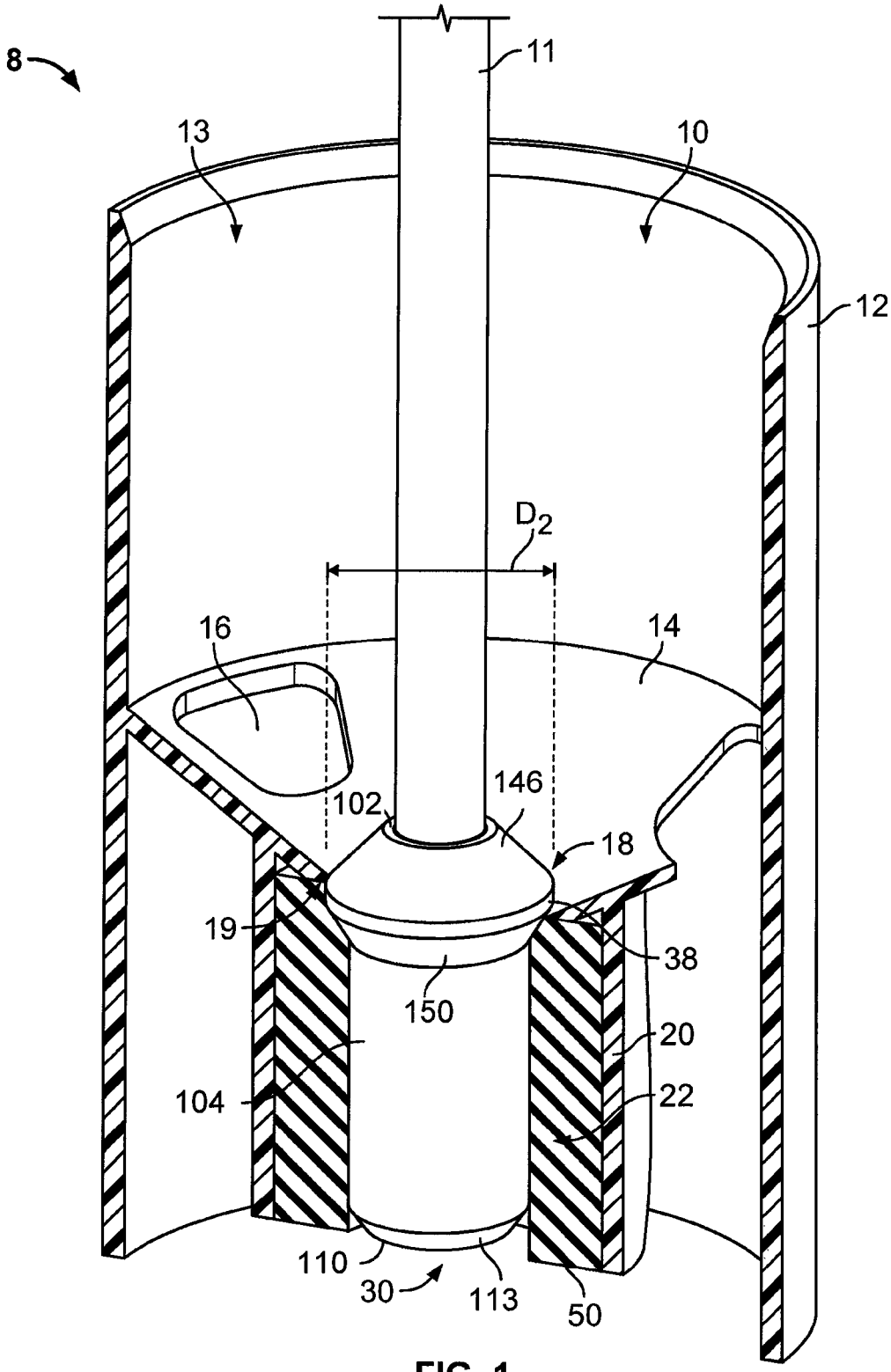
FIG. 1 is a cross-sectional view of an exemplary golf cup and flagpole assembly.

A flagpole and ferrule assembly shown mounted in an exemplary golf cup liner is illustrated in FIG. 1. In one approach, the ferrule includes a retention assembly that is configured to secure a body of the ferrule to the flagpole with a frictionally-tight fit without the use of adhesive, glue, screws, bolts, crimping and the like. In one aspect, the retention assembly includes cooperating coupling parts to secure and lock a ferrule body to the flagpole. In another aspect, the cap is molded over both the ferrule body and flagpole to secure these components together. In yet another aspect, the ferrule body is a ceramic material and the overmolded cap is a plastic or polymer material.

Referring to FIG. 1, an exemplary golf cup and flagpole assembly 8 is illustrated. In one form, the assembly 8 includes a plastic golf cup hole liner 10 and a flagpole 11, which can be used in a golf green, putting area, or the like. The golf cup liner 10 includes a generally cylindrical liner tube 12 defining a golf ball receiving space 13. The tube 12 may have a lower, generally inclined, conical region 14 extending inwardly to the space 13, which may define a plurality of openings 16. The conical region 14 typically has three to four openings 16 to permit water and debris to fall through to the bottom of the tube 12, but it should be understood that the conical region 14 may feature any number of openings 16. In the center of the conical region 14, a ferrule receiving hole 18 may be defined through which a flagpole ferrule 30 passes when inserted into the golf cup hole liner 10. Extending downwardly from the conical region 14 is an annular retention wall 20, which defines a cylindrical pocket 22. The ferrule 30 is received in the pocket 22. Received in the pocket 22 may also be an optional insert or coupling member 50, which may be formed from the same ceramic material as the ferrule 30. The optional coupling member 50 will be described in more detail below. The liner tube 12 and the retention wall 20 are depicted with walls that are generally vertical, but it will be appreciated that they may have a slight draft angle, particularly if they are fabricated using injection molding techniques. In a preferred form, the golf cup hole liner 10 is composed of plastic, but it will be appreciated that it may be formed of other materials such as metal, for example aluminum.

Figure 2:
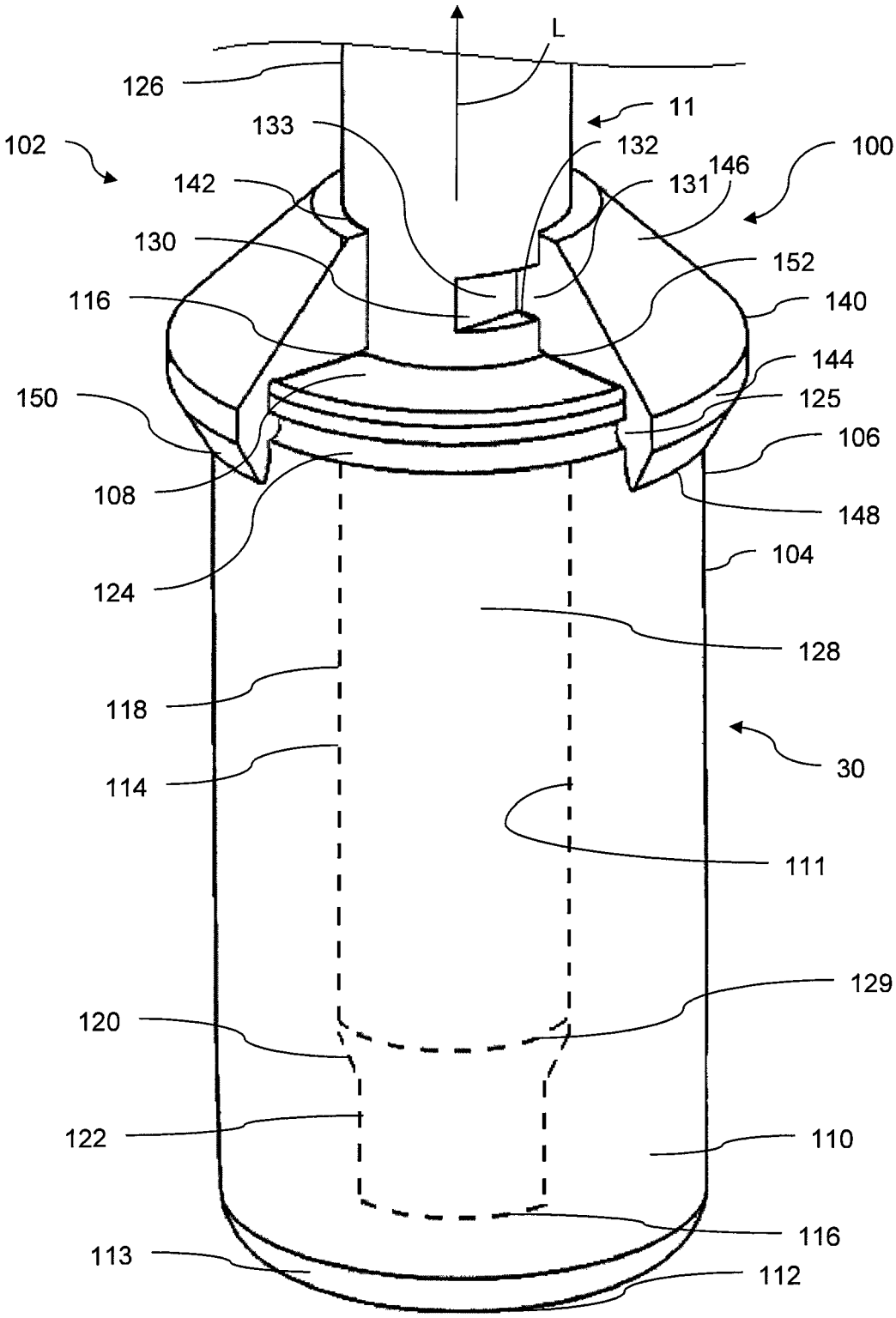
FIG. 2 is a perspective view of an exemplary flagpole assembly.

Turning now to FIG. 2, a first exemplary form of a flagpole assembly 100 is illustrated. The flagpole assembly 100 includes the ferrule 30 having a longitudinal axis L therealong and is attached to the flagpole 11 by a retention assembly including cooperating coupling parts. The assembly 100 includes a separate overmolded cap 102 that defines a first portion of the cooperating coupling parts, a separate ferrule body 101 defining a second portion of the cooperating coupling parts, and a portion of the flagpole 11 defining a third portion of the cooperating coupling parts where all three portions of the cooperating coupling parts function together to secure and/or lock the ferrule 30 to the flagpole 11 without adhesive, glue, screws, bolts, fasteners, crimping or other secondary or separate fasteners.

More specifically, the ferrule 30 preferably has an elongate body 101 sized to be received within the receiving hole 18 of the golf cup hole liner 10 as shown in FIG. 1 (or in the optional coupling member 50). The ferrule body may have an annular side wall 104 that spans between a first or top end 106 of the body having a generally flat top surface 108 and a second or bottom end 110 of the body also having a generally flat bottom surface 112. The bottom surface 112 preferably transitions to the side wall 104 through a chamfered or rounded annular edge 113. In use, the chamfer 113 aids in guiding the ferrule 30 through the hole 18.

The ferrule 30 also has an inner wall 111 that defines a bore 114 extending along the ferrule axis L. The top and bottom surfaces 108, 112 of the ferrule 30 may define openings 116 to the bore 114. Preferably, a top portion 118 of the bore 114 is sized to receive the flagpole 11 therein. An inwardly angled support surface or lip 120 of the bore inner wall 111 transitions the top bore portion 118 to a smaller diameter bottom bore portion 122. The flagpole 11 is inserted into the bore 114 through the top opening 116 and engages the support surface 120, which supports the flagpole 11 within the bore 114 at a chosen depth and prevents further insertion of the flagpole 11 into the ferrule 30.

The bottom bore portion 122 advantageously minimizes loose debris from impeding the entry of the ferrule 30 into the golf cup because such debris can be received within the bottom portion 122 of the ferrule bore 114 rather than between the ferrule 30 and the cup liner and/or the coupling member 50. The support surface 120 may extend generally perpendicularly to the longitudinal axis L of the ferrule 30 or, as shown in FIG. 2, may be inclined inwardly with respect to the axis L. In one example, the support surface 120 is recessed from the top surface 108 about 30 to about 40 mm into the bore 114 or about 60% to about 70% of the length of the ferrule 30. By another approach, the support surface 120 can close off the bore 114 instead of transitioning to the bottom portion 122 and the bottom portion 122 may not be included.

As mentioned above, the flagpole and ferrule utilizes a retention assembly to secure and/or lock the flagpole 11 in the bore 114 of the ferrule body. One approach of the retention assembly utilizes no other separate fasteners (screws, bolts, clips, and the like), crimping, deforming, adhesive, and/or glue other than the cooperating or coupling features defined on the ferrule 30, the flagpole 11, and the overmolded cap 102 as shown in FIG. 2. In one approach, the retention assembly secures the flagpole to the ferrule in a non-rotating manner such that the flagpole is substantially prevented from rotating within the bore 114.

In one approach, the retention assembly may include a first or ferrule coupling part 124 defined on the ferrule 30 that cooperates with a second or lower cap coupling part 125 defined on the cap 102 to secure the cap 102 to the ferrule body. By one approach, the coupling parts 124 and 125 may be a tongue and groove type assembly that cooperatively couple together. The retention assembly also includes a third or flagpole coupling part 130 defined on the end of the flagpole 11 adjacent to the end received in the ferrule bore 114 that cooperates with a fourth or upper cap coupling part 131 also defined on the cap 102 to secure the cap 102 to the flagpole 11. By one approach, the flagpole and cap retaining parts 130 and 131 may also be a tongue and groove type assembly. In another approach, the flagpole and cap retaining part 130 and 131 are configured to secure the flagpole to the cap in a non-rotating manner. So configured, the flagpole 11 and the ferrule 30 are each independently secured to the cap 102 through the plurality of cooperating coupling parts and, therefore, the cap 102 functions to secure the flagpole 11 to the ferrule 30 without the use of adhesive, crimping, screws, bolts, or other secondary fasteners.

Referring again to FIG. 2, the ferrule 30 includes a portion of the retention assembly thereon in the form of the first or ferrule coupling part 124. By one approach, the ferrule coupling part 124 is formed at the side wall 104 of the ferrule body 101 and positioned adjacent the first end 106. In the illustrated form, the ferrule coupling part 124 is an annular groove extending around the circumference of the ferrule 30 at the top or first end 106. The annular groove may extend into the body of the ferrule 30 having a concave profile with a generally semi-circular cross-section in a plane along the longitudinal axis L. The groove may define a curved or concave contact surface. The ferrule coupling part 124 could alternatively be one or more non-annular recesses, slots, or other features extending completely or partially around the side wall 104 such as dimples, protrusions, ribs, and the like as well as any combination thereof.

In another approach, the ferrule coupling part 124 could protrude from the side wall 104 of the ferrule 30 to form tabs, ribs, flanges, rims and the like as well as combinations thereof. As illustrated, the ferrule coupling part 124 is generally transverse and, in one approach, perpendicular to the ferrule axis L and parallel to the flat top surface 108 of the ferrule; however, the ferrule coupling part 124 could alternatively be disposed an angle or inclined thereto or even parallel to the axis L.

The flagpole 11 is preferably an elongate cylindrical member or pole configured to be received within the bore 114 of the ferrule 30. In some approaches, the flagpole 11 includes a generally annular side wall 126 with a bottom portion 128 that is received within the ferrule 30. When inserted into the ferrule bore 114, a bottom surface 129 of the pole may abut the bore stop surface 120 preventing the flagpole 11 from being inserted further as generally shown in FIG. 2.

The flagpole 11 defines another of the cooperating coupling parts in the retention assembly. For example, the third or flagpole coupling part 130 is defined on the side wall 126 of the flagpole 11. In one approach, the coupling part 130 is spaced a distance from the end of the flagpole 11 so that when the flagpole 11 is received in the ferrule bore 114, the flagpole coupling part 130 is positioned adjacent and above the first end 106 of the ferrule 30. The flagpole coupling part 130 may be least one notch, slot, recess, groove, or other indentation formed in or cut into the side wall 126 of the flagpole 11. In the illustrated example, the coupling part is a notch or slot extending into the body of the flagpole 11 and is defined by spaced top and bottom, generally flat, parallel walls or contact surfaces 132 connected by a flat, transverse interior wall 133. The flagpole coupling part 130 could alternatively be one or more annular features extending completely or partially around the side wall 126 such as grooves, dimples, protrusions, ribs, or a combination thereof. By another approach, the flagpole coupling part 130 could protrude from the flagpole side wall 126 to form tabs, walls, ribs, flanges, rims, and the like as well as any combinations thereof. The flagpole coupling part 130 is generally transverse and, in one approach, perpendicular to the axis L and generally parallel to the ferrule flat top surface 108; however, the flagpole retaining part 130 could alternatively be disposed an angle or inclined relative thereto.

The overmolded cap 102 is a generally disc-shaped body having an outer side wall 140 that (when overmolded the ferrule body 101 and flagpole 11) is disposed radially outwardly over portions of the flagpole 11 and the ferrule 30. The side wall 140 defines a top opening 142 through which the flagpole 11 extends upwardly. In one approach, the top opening 142 fits tightly against the side wall 126 of the flagpole 11, such as directly abutting the side wall 126 of the flagpole 11. The side wall 140 tapers downwardly and outwardly from the top opening 142 to an intermediate annular side wall portion 144 forming an inclined and upwardly facing top surface 146 of the cap therebetween. The side wall 140 then tapers inwardly and downwardly from the annular side wall 144 to a bottom opening 148 forming a downwardly facing surface 150 therebetween. The bottom opening 148 may be disposed and tightly engage the ferrule side wall 104. By one approach, the bottom opening 148 has a larger diameter than the top opening 142 to accommodate the ferrule body 101. The overmolded cap 102 further includes an interior wall 152 having a profile that abuts and engages the flagpole side wall 126, the ferrule side wall 104, and the ferrule top surface 108.

When the flagpole assembly 100 is inserted into the golf cup hole liner 10 and/or the coupling member 50, the upwardly facing top surface 146 of the overmolded cap 102 may form a portion of the bottom of the golf cup and the downwardly facing surface 150 may be sized to engage and/or abut a chamfer 54 of the golf cup bore 52 to support the ferrule 30 within the bore 52. By one approach, the cap 102 is made of a plastic or polymer material that cushions or absorbs impact upon insertion of the ferrule 30 into the golf cup. In another approach, the overmolded cap 102 may have a decorative color such as red, green, blue, yellow, and the like as well as any combination of colors.

The cap 102 also includes another portion of the cooperating coupling parts. To this end, the cap interior wall 152 defines both the second or lower cap coupling part 125 and the fourth or upper cap coupling part 131, which are positioned to mate or couple to the coupling parts 124, 130 on the ferrule 30 and flagpole 11, respectively. In one approach, the cap coupling parts are outwardly defined protruding portions to mate and couple with the inward recesses of the ferrule and pole coupling parts 124 and 130, respectively. Alternatively, if the coupling parts 124 and 130 are protruding structures, then the cooperating coupling parts 125 and 131 in the cap are corresponding recesses or grooves or the like to couple therewith.

The lower cap coupling part 125 may be a tongue, rim, protrusion, or other extending cap portion that is complementary or defined to be in a coupling relationship to the ferrule coupling part 124 in the ferrule side wall 104. For example, the cap coupling part 125 may be tongue-like member such as an annular convex protrusion or rib that encircles a perimeter of the cap inner wall 152 and is sized to be received or seated in the ferrule coupling part 124 in a mating or cooperating engagement. The convex rib may define an outwardly curved contact surface that engages the inwardly curved contact surface of the ferrule groove 124.

The upper cap coupling part 131 may also be a protruding tongue, rib, protrusion, or other extending cap portion that is generally complementary or defined to be in a keyed or coupling relationship to the flagpole coupling part 130 formed in the flagpole side wall 126. For example, the cap coupling part 131 may be a tab generally defined by flat upper and lower protruding contact surfaces 137 that are oriented substantially parallel to each other and an outer flat, contact surface 135 spanning between the upper and lower surfaces to form the protruding tab. In this approach, the outer flat contact surfaces 135, 137 of the cap part 131 are configured to contact or engage the interior walls 132, 133 of the flagpole slot 130 in a mating or cooperating engagement, and in the exemplary form, the flat walls contact or abut each other. For instance, the flat wall 133 of the pole groove contact or engages the flat outer wall 135 of the cap tab. Advantageously, because of the flat wall 133 abutting against the flat outer tab wall 135, the flagpole is secured or locked to the cap in a non-rotating manner such that the flagpole is substantially prevented from rotating relative to the cap 102. This arrangement provides an advantage over prior flagpole assemblies using glue or screws to fasten a pole to a ferrule because if the glue or fastener failed or weakened, the pole could easily be turned or rotated in the ferrule.

In one approach, the overmolded cap 102 is a one-piece construction (separate from the ferrule body 101), and in one form, can be molded over portions of the pre-assembled ferrule and the flagpole by injection molding techniques. To this end, a pre-assembled ferrule 30 and the flagpole 11 is placed into a mold cavity of an injection molding machine with the flagpole extending out from the mold. The mold preferably has an interior wall sized and shaped to defined the cap 102. The cap material is then injected into the mold to form the cap 102 around portions of both the flagpole and ferrule. The cap material is initially flowable to substantially fill the mold cavity and subsequently hardens to form the cap. By one approach, the ferrule bore 114 may define a slight gap and/or a tolerance with the pole in order to receive the flagpole 11 somewhat loosely therein. So configured, the flowable cap material can at least partially fill into the space or gap between the flagpole 11 and the bore 114 help aid in fixing the pole to the ferrule. This advantageously provides a tighter fit for the flagpole 11 within the ferrule 30 and/or provides a relatively soft buffer surface between the flagpole 11 as it is pressed against the ferrule 30, such as by removal from the golf cup, wind, or the like.

By one approach, the cap 102 may be composed of a polymer, which can be any thermoplastic, thermoset, elastomer, polyolefin, blends, or hybrids thereof capable of injection molding. In one approach, the cap 102 may be a nylon polymer. As the cap 102 is injected into the mold, it flows into and/or around the coupling parts 124, 130. Then, the cap 102 hardens to couple with and/or enclose the parts 124, 130 to secure the cap 102 to ferrule 30 and flagpole 11. So positioned, the cap 102 secures the ferrule 30 to the flagpole 11 by securing to both the coupling members 124, 130 at the same time. Advantageously, this configuration and method secures the ferrule 30 to the flagpole 11 without relying on or using adhesive, separate fasteners, crimping, or otherwise deforming any portions of the assembly, which can fail or weaken with repeated usage or stress over time, as described above.

As the cap material is injected into the mold, the material fills into the ferrule coupling part 124 and the flagpole coupling part 130 to form the upper and lower cap coupling parts 131, 125. Once formed after injection molding, the upper and lower cap coupling parts 131, 125 are defined to be complementary coupling parts to the ferrule and flagpole retaining parts 124, 130, such as in a tongue and groove assembly. In one approach, the cooperating coupling parts are formed to tightly fit, mate, or seat with its corresponding coupling part with respective contact surfaces engaging each other without the use of adhesive, glue, screws, bolts, crimping, or other secondary fasteners.

Figure 4:
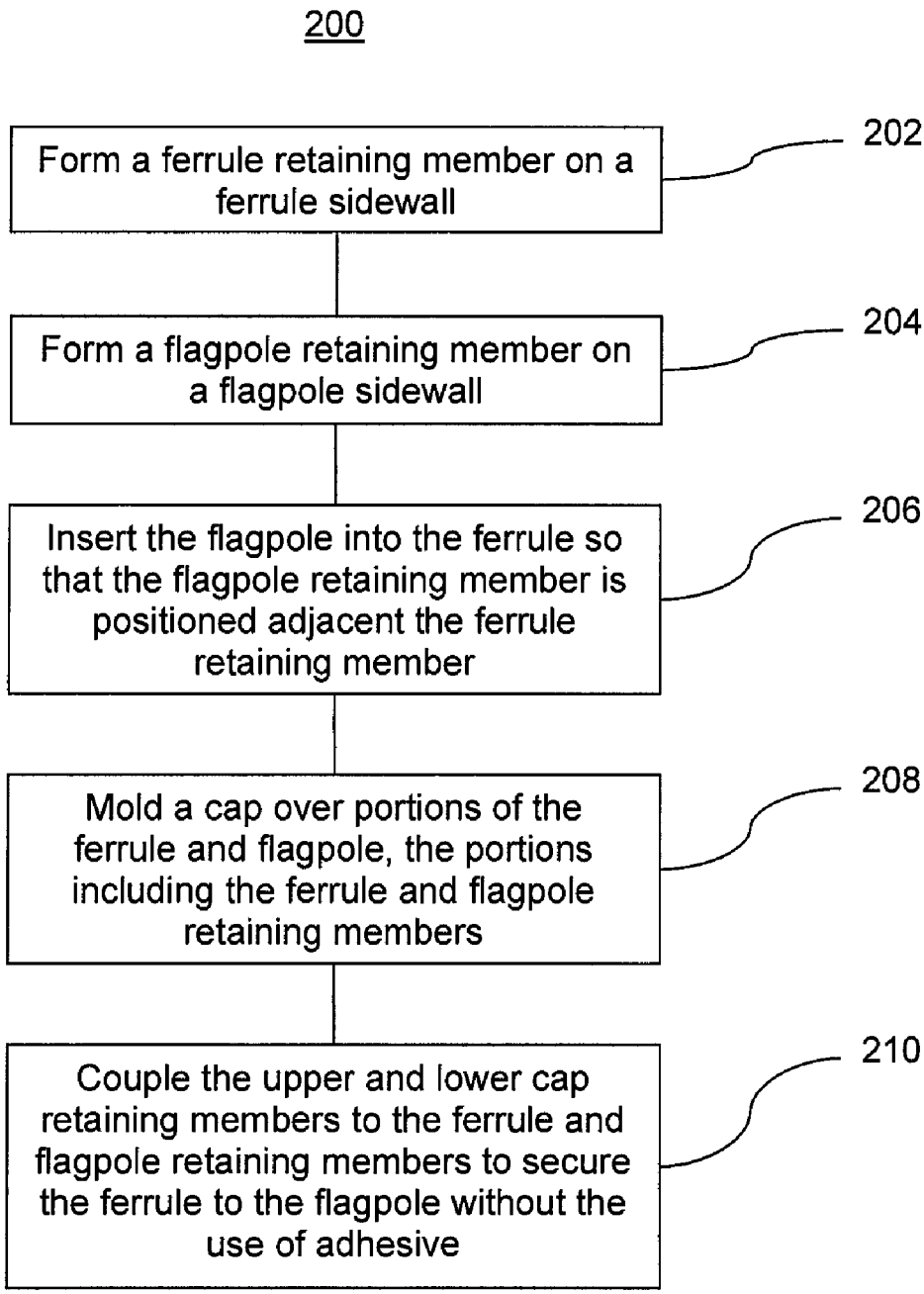
FIG. 4 is a flowchart showing fabrication of the flagpole assembly of FIG. 2.

Turning to FIG. 4 for a moment, exemplary steps for assembly of the flagpole and ferrule assembly 8 as illustrated in FIG. 2 are shown. First, the ferrule coupling part 124 is formed 202 at the ferrule side wall 104 adjacent the top surface 108 of the ferrule 30. In one approach, the ferrule 30 may be a ceramic material (to be discussed in more detail below) and, as the ceramic ferrule 30 is being formed, the ferrule coupling part 124 can also be formed into the ferrule side wall 104. Next, the flagpole coupling part 130 is formed 204 in the flagpole side wall 126. In one approach, the flagpole may be composed of a fiberglass material. Accordingly, the flagpole coupling part 130, which is shown as a slot in FIG. 2, can be formed in the flagpole side wall 126 by cutting or notching the pole. Next, the flagpole 11 is inserted 206 into the ferrule bore 114 such that the flagpole coupling part 130 is positioned a distance spaced above and adjacent the ferrule top surface 108 to form a pre-assembly of the ferrule and flagpole. The preassembly is placed into a mold cavity so that the flagpole extends outwardly from the cavity. The mold cavity defines the shape of the cap 102. Next, the cap 102 is overmolded 208 to cover both portions of the ferrule 30 and the flagpole 11. As the cap 102 is over molded onto the ferrule 30 and flagpole 11, the cap upper and lower coupling parts 131, 125 are formed through the injected molded cap to cooperatively couple 210 to both the ferrule and flagpole coupling parts 130, 124, respectively, to secure the ferrule 30 to the flagpole 11.

Figure 3:
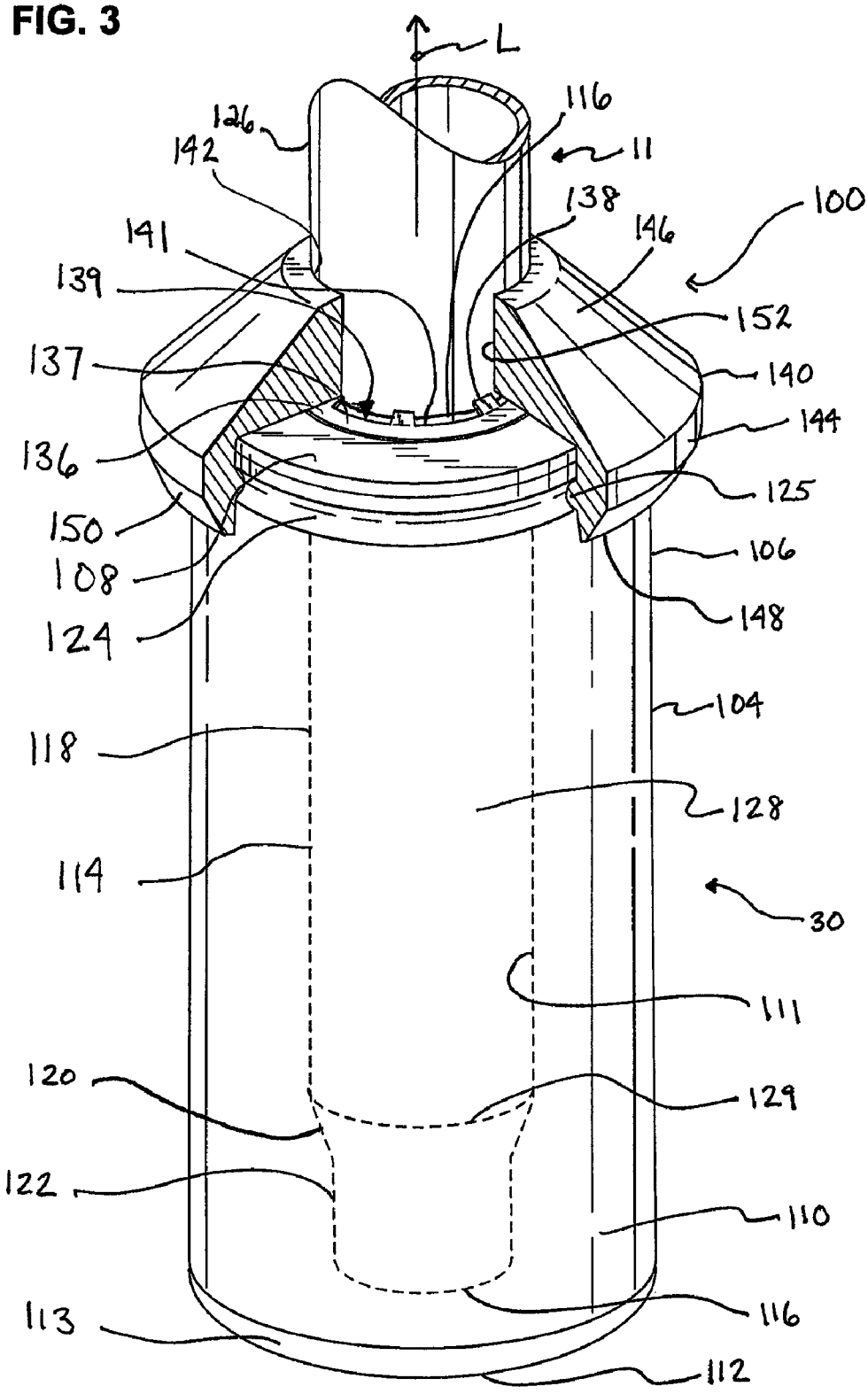
FIG. 3 is a perspective view of an exemplary alternative flagpole assembly.

Turning now back to FIG. 3, the flagpole assembly 100 is shown with an alternative retention assembly. In this form, rather than the third and fourth coupling parts 130, 131 on the flagpole 11 and cap 102, respectively, the retention assembly in this form includes a separate gripping member 136 molded between the flagpole 11 and the cap 102. By one approach, the gripping member 136 is a gripping ring or clip which may be formed of a resilient material, such as a metal, plastic, ceramic, or the like. The gripping ring 136 tightly secures to the flagpole and the overmolded cap 102 captures the ring between the cap 102 and the upper surface 108 of the ferrule to secure the assembly together.

The overmolded cap 102 of this approach may have a similar shape or profile as described above with respect to FIG. 2. The cap 102 includes a disc-shaped side wall 140 that is disposed radially outwardly over portions of the flagpole 11 and the ferrule 30 with the top opening 142. The side wall includes the upwardly facing surface 146, the annular side surface 144, the downwardly facing surface 150, the bottom opening 148, and the interior wall 152 that abuts and engages the flagpole side wall 126, the ferrule side wall 104, and the ferrule top surface 108. The cap interior wall 152 as illustrated in FIG. 3 also includes the second or lower cap coupling part 125 to cooperatively couple to the ferrule coupling part 124 similar to the embodiment shown in FIG. 2.

In this approach, the gripping ring 136 includes an annular body 137 in the form of a relatively thin ring defining a central space 139 with one or more inwardly projecting resiliently bendable fingers or segments 138 that extend from an inner edge 141 of the ring body 137 into the space 139. The ring may include between 3 and 10, and in some cases, 6 fingers. In one approach, the fingers are provided in opposing pairs defined on opposite sides of the ring body 137. The fingers 138 are slightly malleable, but sufficiently resilient so that if an object (such as the flagpole) is inserted into the ring 136 and has a diameter greater than a transverse length between opposing fingers positioned on opposite sides of the space 139, the fingers 138 flex to allow the object through. Advantageously, the resiliency of the fingers 138 allows the fingers 138 to tightly grip the object and secure the ring 136 thereto. As illustrated in FIG. 3, the flagpole 11 has an outer diameter larger than the transverse length between opposing fingers in the space 139, which deflects or flexes the fingers 138 upwardly. So configured, the fingers 138 resiliently grip or tightly engage the side wall 126 of the flagpole 11 to secure the ring 136 to the flagpole 11. In the illustrated form, the fingers 138 are generally rectangular; however, they can take other suitable shapes, such as triangular, rounded, or the like.

The overmolded cap 102 of this form may also be formed by injection molding as discussed above. Accordingly, the overmolded cap 102 secures to the flagpole 11 by flowing around the ring 136 to capture and/or at least partially embed the ring 136 between the lower surface of the cap 152 and the ferrule upper end 108. Generally, the cap material, as it is injection molded, tends to flow around the ring body 137 and into the spaces adjacent the fingers 138 between the ring inner edge 141 and the flagpole side wall 126. After allowing the cap material to harden, the overmolded cap 102 encloses at least portions of the ring 136 and preferably all of the ring body 137 and fingers 138. This configuration and method secures the ferrule 30 to the flagpole 11 without relying on or using adhesive, screws, and the like which can fail with repeated usage or stress, as described above.

As mentioned above, the flagpole 11 may be made of fiberglass or wood. Such a material can be scratched, dented, or otherwise damaged relatively easily. Accordingly, directly sliding the ring 136 over the flagpole side wall 126 to mount the ring thereto can damage the flagpole 11 because the fingers could scratch the flagpole wall. In order to avoid this, an insertion tool 162, such as a mounting tool, can be used. The tool 162 defines an annular wall having a hollow interior cavity sized to receive the flagpole 11 therein. An outer edge of the tool 152 has a chuck to receive the ring 136 thereon to aid in positioning the ring over the pole without damaging it as shown in the method 300 of FIG. 5. By one approach, an exterior of the tool chuck has a diameter sized to slightly flex the fingers 138 of the ring 136 outwardly as shown in step 304 so that the diameter between opposing fingers is larger than the diameter of the flagpole. In one approach, the fingers 138 may be flexed outward about 0.005 to about 0.010 inches to cleanly allow the ring 136 to be inserted over the flagpole. Once inserted to the desired location on the flagpole, the tool 162 is removed 306, which allows the ring to slide off the chuck so that the ring fingers 138 resiliently flex inward to grip the flagpole as shown in the final method step 308.

Figure 5:
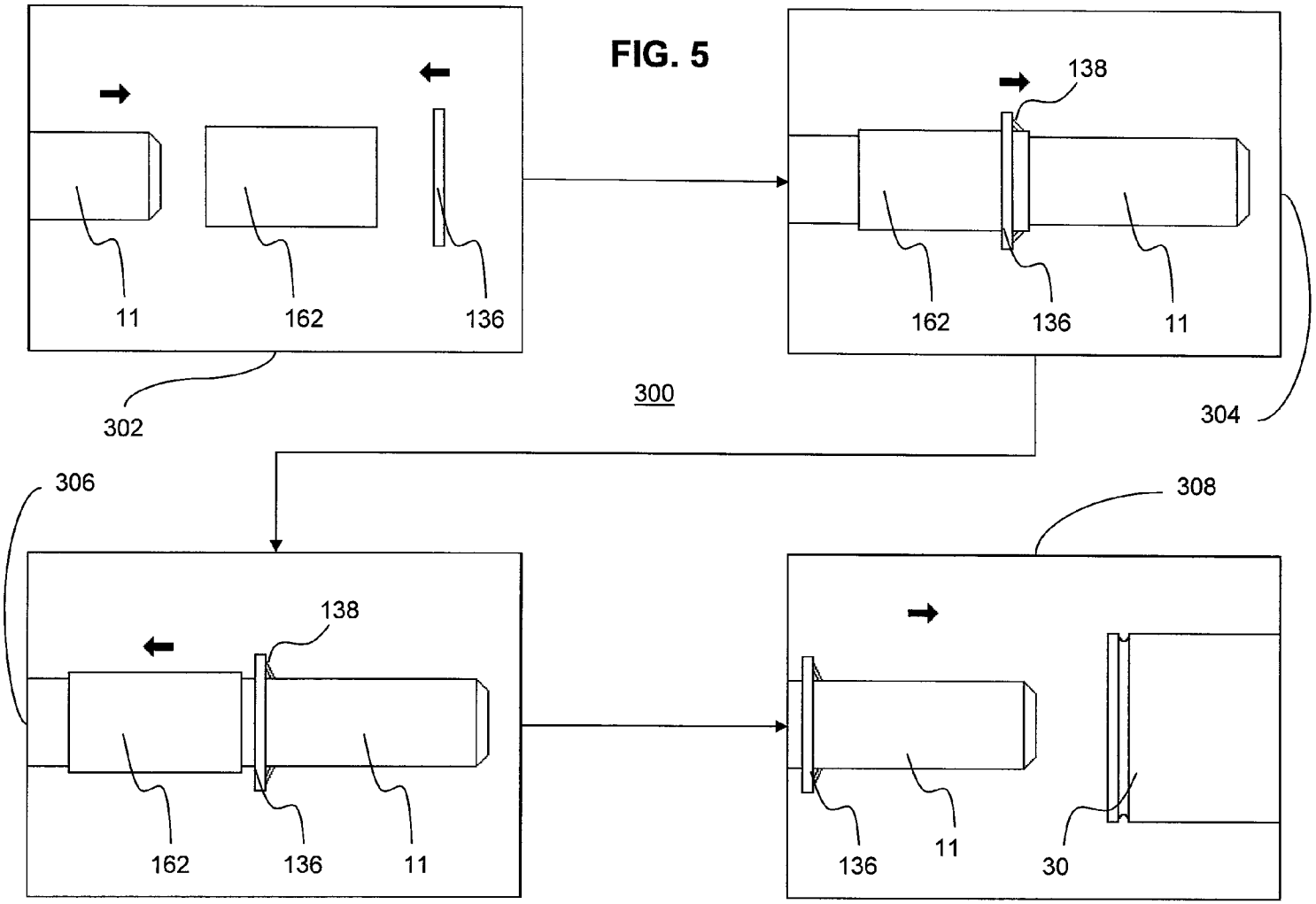
FIG. 5 is a flowchart showing fabrication of the flagpole assembly of FIG. 3.
Figure 6:
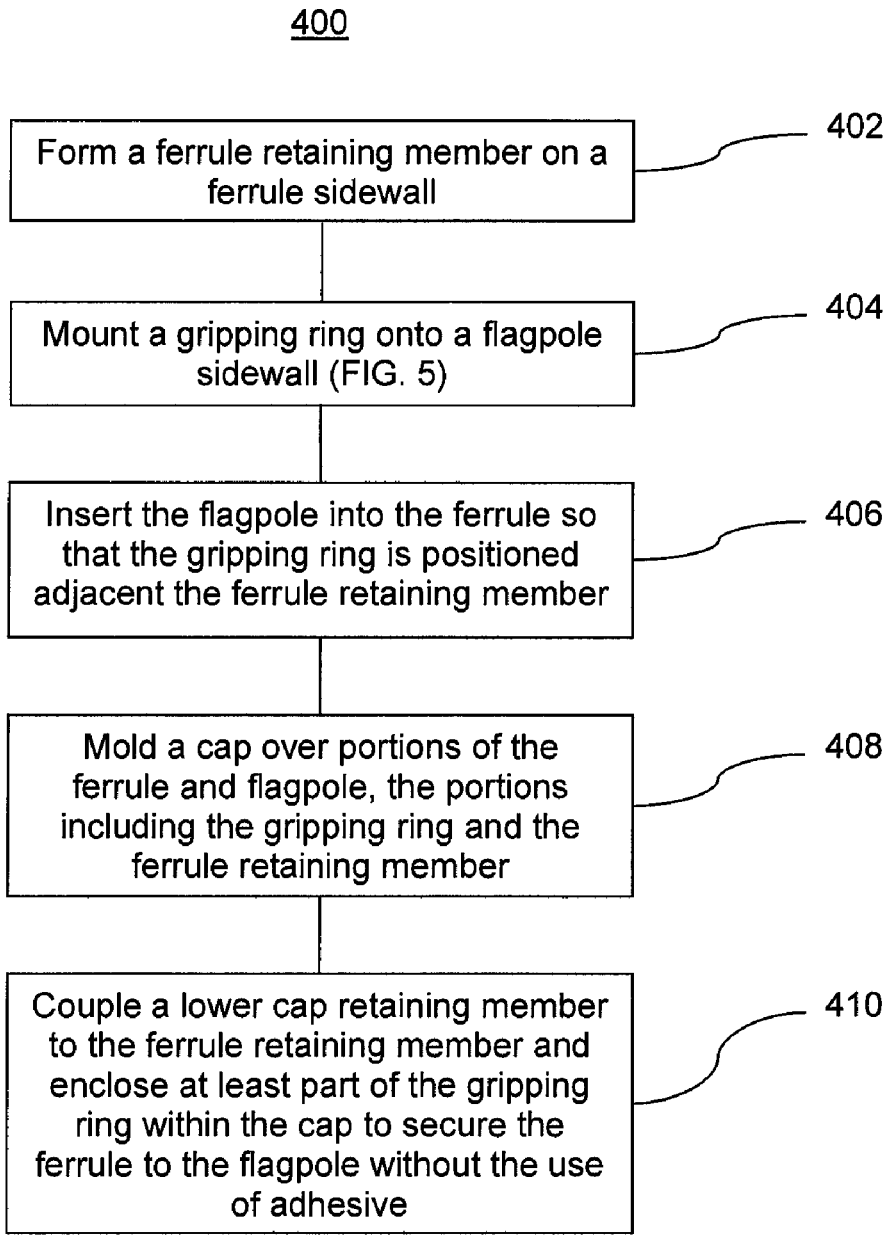
FIG. 6 is a flowchart showing fabrication of the flagpole assembly of FIG. 3.

One exemplary method 400 for assembling the flagpole and ferrule assembly 8 shown in FIG. 3 is illustrated in FIG. 6. As discussed above, the retention assembly includes in part the ferrule coupling part 124 and the gripping ring 136 secured to the flagpole 11. Accordingly, the ferrule coupling part 124 is first formed 402 on the ferrule side wall 104 adjacent the top surface 108 of the ferrule 30. In the illustrated form, the ferrule 30 is a ceramic material and as the ferrule 30 is being formed, the coupling part 124 is formed into the ferrule side wall 104. Next, the gripping ring 136 is mounted to the flagpole 11 as shown in FIG. 5 above. Then, the ferrule 30 with the flagpole 11 received partially therein with the ring abutting the ferrule top surface 108 is placed into an injection mold and the overmolded cap 102 is disposed 408 over the ring 136 and the ferrule coupling part 124. The cap material flows around the ring 136 and its fingers 138 to secure 410 the ring 136 within the cap 102 and flows into or around the ferrule coupling part 124 to form the cap lower coupling part 125 that couples 410 to the ferrule coupling part 124. The ring is captured between the ferrule top surface 108 and the lower inner wall 152 of the overmolded cap. To this end, the lower coupling part 125 secures the cap 102 to the ferrule 30 and because the ring 136 is secured to the flagpole 11 and enclosed within the overmolded cap 102, the cap 102 secures the flagpole 11 to the ferrule 30 without the use of adhesive or screws.

Figure 7:
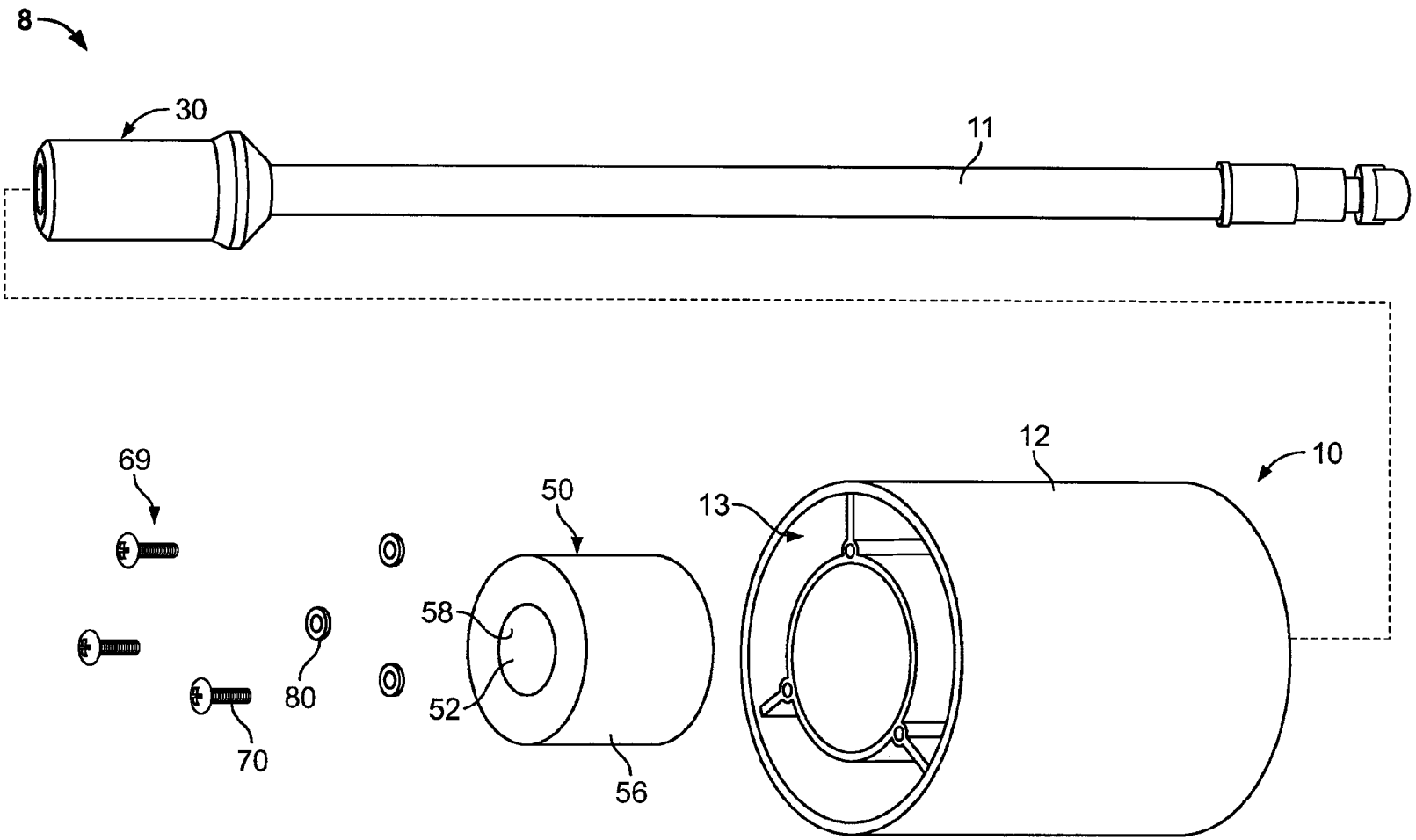
FIG. 7 is an exploded view of the assembly of FIG. 1.
Figure 8:
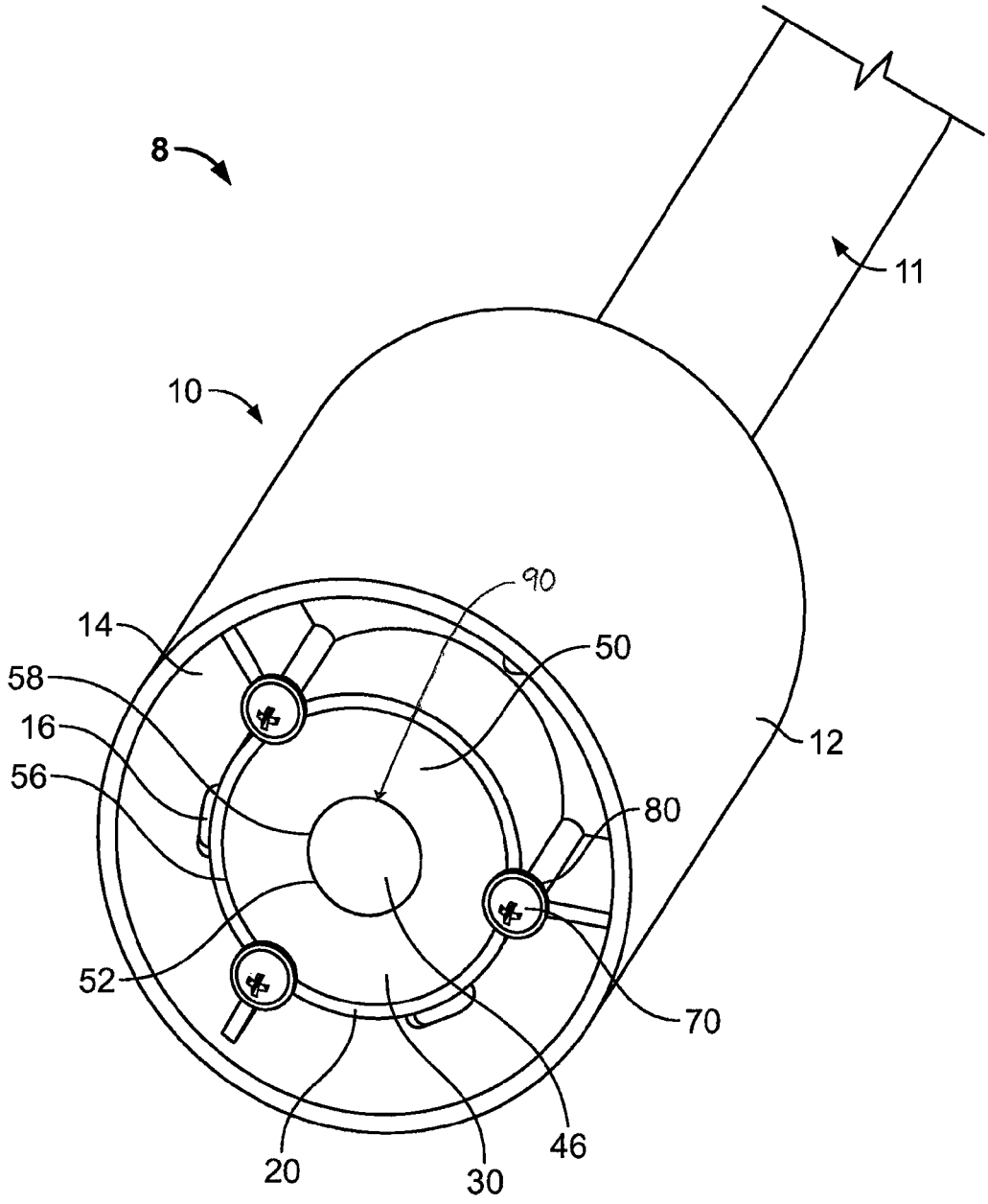
FIG. 8 is a bottom perspective view of the assembly of FIG. 1.
Figure 9:
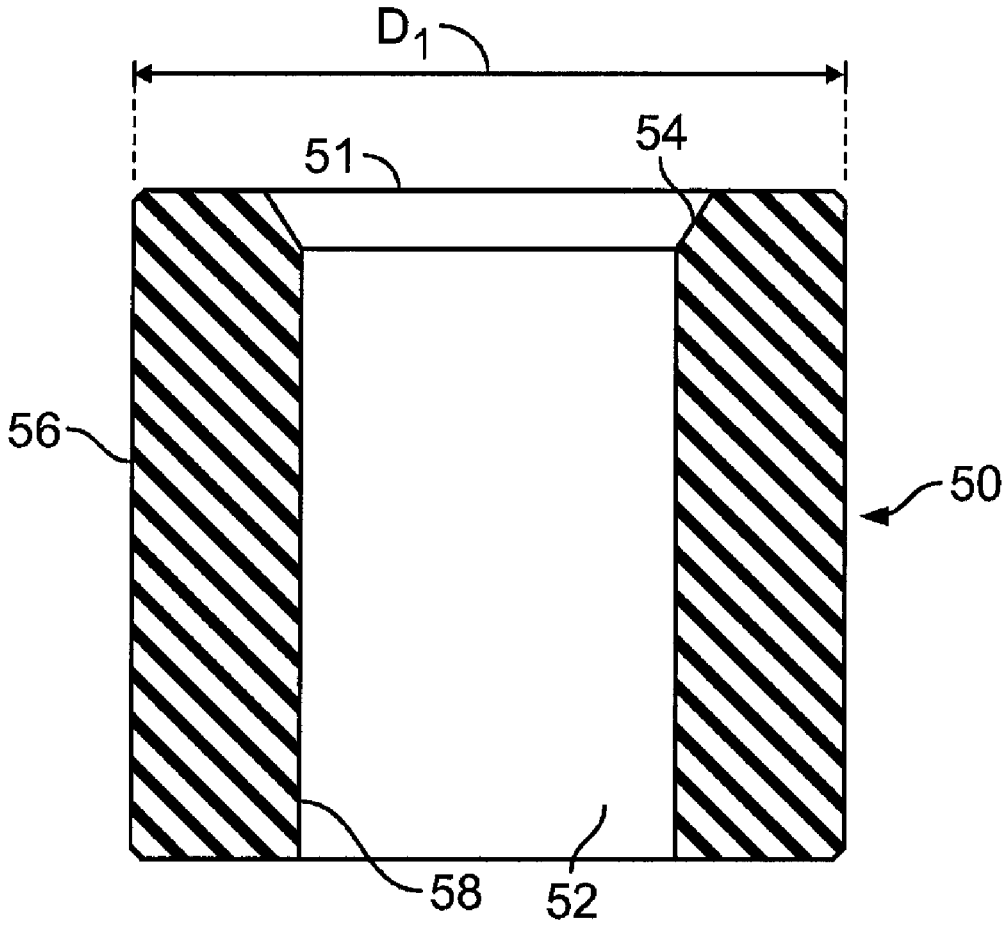
FIG. 9 is a cross-sectional view of an exemplary coupling member for use in the assembly of FIG. 1.

Turning now to FIGS. 7-9, the golf cup and flagpole assembly 8 is shown illustrating one form of the optional coupling member 50 suitable for use therewith in more detail. In such form, the coupling member 50 is an annular insert, having an outer wall 56 and an inner wall 58 defining a bore 52 extending through the coupling member. A first or upper end 51 of the bore 52 terminates in a chamfer 54, which is inclined outwardly to complement the lower cap surface 150 on the ferrule 30. As further described below, the coupling member 50 is preferably formed from a non-metallic material such as ceramic, and most preferably a ceramic composite material.

In use, the coupling member 50 is received in the annular pocket 22 such that the outer wall 56 of the coupling member 50 is adjacent to the annular retention wall 20 of the tube liner 12. Preferably, the coupling member 50 is inserted into the pocket 22 from the bottom of golf cup hole liner 10 and retained therein by at least one fastening member 69. As illustrated in FIGS. 7 and 8, one exemplary form of the fastening member 69 is a plurality of screws 70 and washers 80. Although three screws and washers are shown, it will be appreciated that the coupling member 50 could be retained within the pocket 22 using any number of fastening members 69 or with different fastening methods, such as a friction-fit, clips, bolts, adhesive, glue, tape, flanges, and the like, so long as the fastening member 69 secures the coupling member 50 into the pocket 22. In one form, an outer diameter D1 (FIG. 9) of the coupling member 50 is larger than an inner diameter D2 (FIG. 1) of the ferrule receiving hole 18 such that the coupling member 50 may be fully seated within the pocket 22 using the fastening member 69, a lower surface 19 of conical region 14, and the retention wall 20.

In a preferred form, both the ferrule 30 and the optional coupling member 50 are constructed from substantially the same non-metallic material such as a ceramic, and preferably substantially the same ceramic composite material. In one embodiment, the ferrule 30 and coupling member 50 are formed primarily from an aluminum oxide ($Al_2O_3$) composite, such as aluminum oxide composites provided by CerCo, LLC (Shreve, Ohio), but it will be appreciated that the composite material could also contain zirconium oxide, silicon nitride, and/or mixtures thereof. The ceramic material may also include a minor component or secondary material. For example, the minor component may include any mineral within the spinel class of minerals, another crystalline material, or an amorphous (i.e., noncrystalline) material. For example, the minor component may be $MgAl_2O_4$. For purposes herein, spinel refers to a class of minerals which crystallize in the isometric system with an octahedral habit.

Ferrules and coupling members constructed from the same ceramic materials have many advantages over the conventional metals or plastics used to construct ferrules and receiving holes of the prior art. Preferred composites for the ferrules and coupling members described herein have Vickers hardness numbers in excess of about 980HV5 (kg/mm$^2$), which is generally hard enough to substantially resist damage from any debris, rock, sand, and the like found on a golf course or putting environment. Preferred materials also exhibit a tensile strength of about 18 kpsi or greater (ACMA Test #4) and a compressive strength of 235 kpsi or greater (ASTMC-773-74). Rather than being scratched or damaged by debris, the ceramic ferrules and coupling members described herein preferably crush or pulverize any debris trapped between them generally due to the hardness of the ceramic material used to form the ferrule and coupling member. In addition, the preferred composites are generally chemically inert and generally pose little variation upon exposure to moisture or temperature gradients. In addition, because the ferrule 30 and coupling member 50 are of the same non-metallic materials, they are generally not subject to galvanic corrosion.

The ferrule 30 and coupling member 50 formed from ceramic composites may also be fabricated to greater tolerances than their metal and plastic counterparts. Prior metal/plastic ferrules and cup receiving holes, for example, feature tolerances that generally create a gap of about 0.030 to about 0.050 inches or greater therebetween when assembled. On the other hand, the ferrule 30 and coupling member 50 formed from the above-described ceramic materials may be fabricated to have a gap 90 of only about 0.005 to about 0.010 inches between the coupling member inner wall 58 and the side wall 104 of a coupled ferrule 30 (FIG. 8). The smaller gap 90 together with the hardness of ceramic composite material generally permits the ferrule 30 to enter the coupling member 50 and push out, crush, or pulverize any particles or debris that could otherwise lodge between the two and scratch or damage the surfaces therein. The smaller gap 90 also allows the ferrule side wall 104 and the coupling member inner wall 58 to have more substantial contact and generally enable the flagpole 11 to remain upright even in windy conditions.

In addition to increased tolerances, the use of ceramic materials for the ferrule 30 and coupling member 50 also permits a smoother surface than prior plastic and metal components. For example, the ferrule side wall 104 and/or the coupling member inner wall 58 may have a surface finish of about 16 RMS or less, which is smoother than most machined or cast metal and many processed plastics (i.e., a typical metal ferrule has a surface finish of about 20 to 40 RMS). This smooth surface finish permits the ferrule 30 to slide in and out of the bore 52 of the coupling member 50 with low friction and in some cases minimize, and preferably eliminate, sticking or galling of the ferrule in the hole liner.

With the overmolded cap 102 formed of a softer plastic material and the ferrule 30 formed of a harder ceramic material, the ferrule forms a hybrid assembly of materials. The harder ceramic material forming the ferrule 30 is advantageous because it is positioned to generally withstand the forces of being inserted and removed from the cup liner while the upper, overmolded cap is formed from a softer, plastic material that in some cases can cushion the impact from a golf ball dropping in the cup.

While embodiments of the described apparatus have been described in the foregoing, it will be understood that other details, materials, and arrangements of parts and components are possible which are within the scope of the claims and are intended to be included herein.

What is claimed is:

1. A method of assembling a golf flagpole to a ferrule body, the method comprising:

inserting an end of a flagpole into a bore defined in a ferrule body to form a preassembly;

placing the preassembly into an injection mold cavity with the flagpole extending out from the mold cavity; and injecting a plastic material into the mold cavity to form an overmolded cap extending over portions of the flagpole and ferrule body to secure the flagpole to the ferrule body.

2. The method of claim 1, wherein the ferrule body includes a ceramic material.

3. The method of claim 1, further comprising placing a gripping member on the flagpole pole so that the gripping member abuts a top end of the ferrule body prior to placing the preassembly into the injection mold.

4. The method of claim 1, wherein the overmolded cap secures the flagpole to the ferrule through pairs of cooperating coupling parts formed between the flagpole and overmolded cap and between the ferrule and overmolded cap.

5. The method of claim 3, wherein placing the gripping member on the flagpole comprises:

mounting the gripping member on a tool configured to slide over the flagpole;

positioning the tool on the flagpole; and sliding the gripping member off of the tool onto the flagpole.

6. The method of claim 5, wherein mounting the gripping member on the tool comprises flexing fingers of the gripping member outwardly on the tool so that the fingers do not contact the flagpole while positioning the tool on the flagpole.

7. The method of claim 3, wherein injecting the plastic material into the mold cavity comprises forming an indentation in or an extension of the overmolded cap to cooperate with the opposite of an indentation in or an extension of the ferrule body to secure the ferrule body to the overmolded cap and wherein injecting the plastic material embeds the gripping member in the overmolded cap to secure the flagpole to the overmolded cap.

8. The method of claim 4, further comprising an indentation in or an extension of the flagpole as one of the cooperating coupling parts to secure the flagpole to the overmolded cap, the indentation or extension positioned adjacent a top end of the ferrule body prior to placing the preassembly into the injection mold.

9. The method of claim 8, wherein injecting the plastic material into the mold cavity forms an indentation in or an extension of the overmolded cap as the other of the cooperating coupling parts to secure the flagpole to the overmolded cap, the extension or indentation in the flagpole configured to cooperate with the other of the extension or indentation in the overmolded cap to secure the flagpole to the overmolded cap.

10. The method of claim 4, further comprising an indentation in or an extension of the ferrule body as one of the cooperating coupling parts to secure the ferrule body to the overmolded cap.

11. The method of claim 10, wherein injecting the plastic material into the mold cavity forms an indentation in or an extension of the overmolded cap as the other of the cooperating coupling parts to secure the ferrule body to the overmolded cap, the extension or indentation in the ferrule body configured to cooperate with the other of the extension or indentation in the overmolded cap to secure the ferrule body to the overmolded cap.

12. The method of claim 1, further comprising:

an indentation in or an extension of the flagpole as one of the cooperating coupling parts to secure the flagpole to the overmolded cap, the indentation or extension positioned adjacent a top end of the ferrule body prior to placing the preassembly into the injection mold, and wherein injecting the plastic material into the mold cavity forms a first indentation in or extension of the overmolded cap as the other of the cooperating coupling parts to secure the flagpole to the overmolded cap, the extension or indentation in the flagpole configured to cooperate with the other of the first extension or indentation in the overmolded cap to secure the flagpole to the overmolded cap; and an indentation in or an extension of the ferrule body as one of the cooperating coupling parts to secure the ferrule body to the overmolded cap, and wherein injecting the plastic material into the mold cavity forms a second indentation in or extension of the overmolded cap as the other of the cooperating coupling parts to secure the ferrule body to the overmolded cap, the extension or indentation in the ferrule body configured to cooperate with the other of the second extension or indentation in the overmolded cap to secure the ferrule body to the overmolded cap.

13. The method of claim 1, wherein the overmolded cap secures the flagpole to the ferrule body without the use of adhesive.

* * * * *

UNITED STATES PATENT AND TRADEMARK OFFICE

CERTIFICATE OF CORRECTION

PATENT NO. : 8,272,969 B2
APPLICATION NO. : 12/847626
DATED : September 25, 2012
INVENTOR(S) : Jack C. Priegel It is certified that error appears in the above-identified patent and that said Letters Patent is hereby corrected as shown below:

Column 10, line 47, in claim 3, delete the following:

3. The method of claim 1, further comprising placing a gripping member on the flagpole "pole" so that the gripping member abuts a top end of the ferrule body prior to placing the preassembly into the injection mold.

Signed and Sealed this
Fifteenth Day of January, 2013

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,272,969 B2
APPLICATION NO. : 12/847626
DATED : September 25, 2012
INVENTOR(S) : Jack C. Priegel It is certified that error appears in the above-identified patent and that said Letters Patent is hereby corrected as shown below:

Column 10, lines 47-50, claim 3, should read as follows:

-- 3. The method of claim 1, further comprising placing a gripping member on the flagpole so that the gripping member abuts a top end of the ferrule body prior to placing the preassembly into the injection mold. --

This certificate supersedes the Certificate of Correction issued January 15, 2013.

Signed and Sealed this
Nineteenth Day of February, 2013

Teresa Stanek Rea
*Acting Director of the United States Patent and Trademark Office*